US005187533A

United States Patent [19]

Sugiyama et al.

[11] Patent Number: 5,187,533

[45] Date of Patent: Feb. 16, 1993

[54] AUTOMATIC DOCUMENT FEEDER FOR FEEDING DOCUMENTS BASED ON SIGNALS FROM A FINAL DOCUMENT DETECTING DEVICE AND A NORMAL END DETECTING DEVICE

[75] Inventors: Tsukasa Sugiyama, Moriguchi; Ken Yoshizuka, Nagaokakyo, both of Japan

[73] Assignee: Mita Industrial Co. Ltd., Osaka, Japan

[21] Appl. No.: 848,926

[22] Filed: Mar. 10, 1992

[30] Foreign Application Priority Data

Mar. 11, 1991 [JP] Japan ..... 3-044871

[51] Int. Cl.[5] ..... G03G 15/00

[52] U.S. Cl. ..... 355/309; 271/258; 355/316

[58] Field of Search ..... 355/309, 313, 316, 308; 271/258-261

[56] References Cited

U.S. PATENT DOCUMENTS 4,896,876 1/1990 Yamada et al. ..... 271/265

4,937,634 6/1990 Hirabayashi et al. ..... 355/309

*Primary Examiner*—Richard L. Moses

*Attorney, Agent, or Firm*—Beveridge, DeGrandi, Weilacher & Young

[57] ABSTRACT

This invention relates to an improved automatic document feeder which may be used, for example, on an image forming apparatus. The apparatus in accordance with the invention includes a final document detecting circuit which detects whether a document sent from an original setting device onto an original mounting device is the final document of a set. A normal end detecting device detects whether all of the image forming steps have been completed normally as to the final document of the set. A controlling device moves the final document to be discharged outside of the automatic document feeder after all of the image forming steps have been finished normally on the final document. The controlling device is activated based on signals from the final document detecting device and the normal end detecting device. The control circuit allows documents other than the final document to be moved outside of the image forming device before all of the image forming steps have been completed normally.

4 Claims, 3 Drawing Sheets

AUTOMATIC DOCUMENT FEEDER FOR FEEDING DOCUMENTS BASED ON SIGNALS FROM A FINAL DOCUMENT DETECTING DEVICE AND A NORMAL END DETECTING DEVICE

BACKGROUND OF THE INVENTION

1. Field of the Invention

The present invention relates to an automatic document feeder used in a copier or other image forming apparatus for feeding documents automatically.

2. Description of the Related Art

Hitherto, for example, in a copier, instead of having an operator place the documents one by one on the original platen glass, an automatic document feeder (ADF) is known for feeding the documents automatically onto the original platen glass. The known ADF is used by having the operator set the documents on the original tray, automatically feeding the documents one by one to the platen glass, executing copying by scanning each document with the optical system, and then sending out the documents automatically from above the original platen glass.

In such ADFs, a high speed mode can be selected in certain models. That is, after feeding the documents onto the original platen glass as mentioned above, the optical system scans the original from the home position and moves to the rear end of the original, and then returns to the home position. In this process, in order to copy as quickly as possible, high speed copying is realized by sending out the original when the optical system has finished scanning, without waiting until the optical system returns to the home position.

This document feeding timing for high speed operation is also the same for the final document.

However, when the final document is immediately discharged outside right after scanning, as described above, there may be a jamming, for example, while the paper on which the image has been transferred is being conveyed to the thermal fixing unit.

In such a case, the final document, once discharged outside, must be put back onto the original platen glass by the operator. This procedure is not only troublesome, but may involve the risk of returning a wrong document to the platen glass.

SUMMARY OF THE INVENTION

In light of the above-mentioned problem of conventional image forming apparatuses, it is a primary object of the invention to offer an automatic document feeder capable of forming images at high speed as fast as possible, but by saving the labor of re-setting of the documents, as mentioned above.

To achieve the above object, the present invention includes an automatic document feeder for automatically feeding a plurality of documents placed on an original setting means onto an original mounting means of the main body of an image forming apparatus, and after copying, sending the documents outside the automatic document feeder, comprising:

final document detecting means for detecting whether the document sent out from the original setting means onto the original mounting means is the final one or not; normal end detecting means for detecting if all image forming steps have been done normally or not, at least on the final document; moving means for moving the documents; and control means for controlling the moving means so as to send the final document outside only after all image forming steps have been done normally, on the basis of the detection signals from the final document detecting means and the normal end detecting means.

The apparatus in accordance with the present invention detects if the document sent from the original setting means onto the original mounting means is the final one or not by the final document detecting means. The apparatus further detects whether all image forming steps have been finished normally, at least on the final document, by the normal end detecting means. The control means will allow the final document to the discharged outside after all image forming steps have been finished normally, according to the detection signals from the final document detecting means and the normal end detecting means.

DESCRIPTION OF THE PREFERRED EMBODIMENTS

Figure 1:
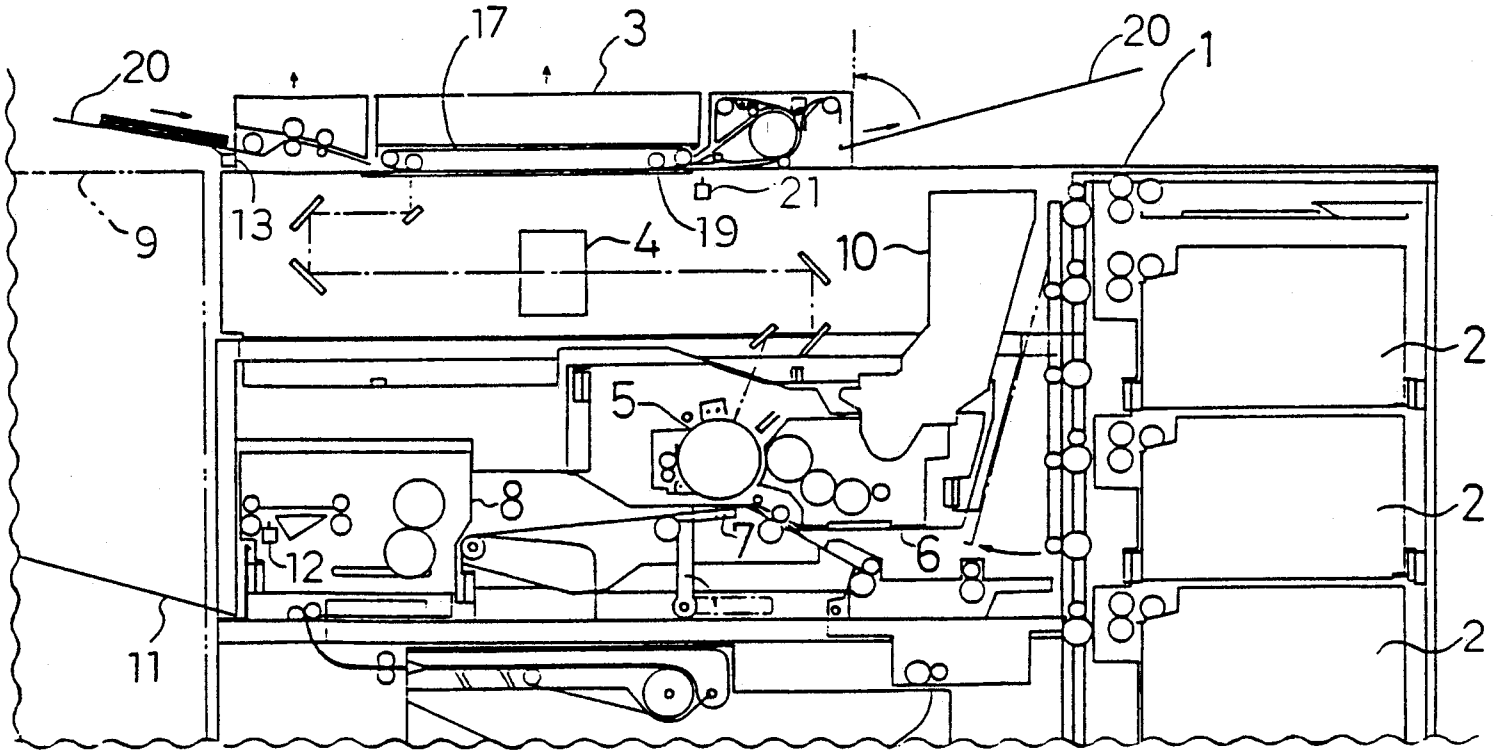
FIG. 1 is a schematic sectional view of a copier using an embodiment of an automatic document feeder of the present invention.

Referring now to the drawings, an embodiment of the present invention is described in detail below.

FIG. 1 is a schematic sectional view of a copier making use of an embodiment of an automatic document feeder of the present invention.

In the drawing, in the upper part of a copier main body 1, an automatic document feeder main body 3 for automatically feeding documents is installed. A paper cassette accommodating copying paper and a deck 2 are set on the right side of this copier. Further, inside the copier, an optical system 4 is positioned for reading documents, and a photoreceptor 5 to be exposed by the scanning of the optical system 4 is provided. The copier further includes a developing means 6 for developing the latent image formed by exposure on the circumference of the photoreceptor 5, a transfer means 7 for transferring the toner visible image developed by the developing means 6 onto the paper, a fixing means 8 for thermally fixing the image onto the transferred paper, and a discharge tray 11. Various other means are also provided in the copier.

On the developing means 6, there is a tubular hopper 10 for replenishing toner to the developing means 6.

At the discharge side of the thermal fixing device 8, a detector switch 12 is disposed for detection of the paper going into the discharge tray 11.

In a document tray 20, as an example of the document setting means, a detection switch 13 is provided as an example of the final document detecting means. An operation panel (not shown) is disposed at the front side of the top of the copier main body 1, and a number setting means 14 is provided, such as a numeric key pad, for setting the number of copies.

Figure 2:
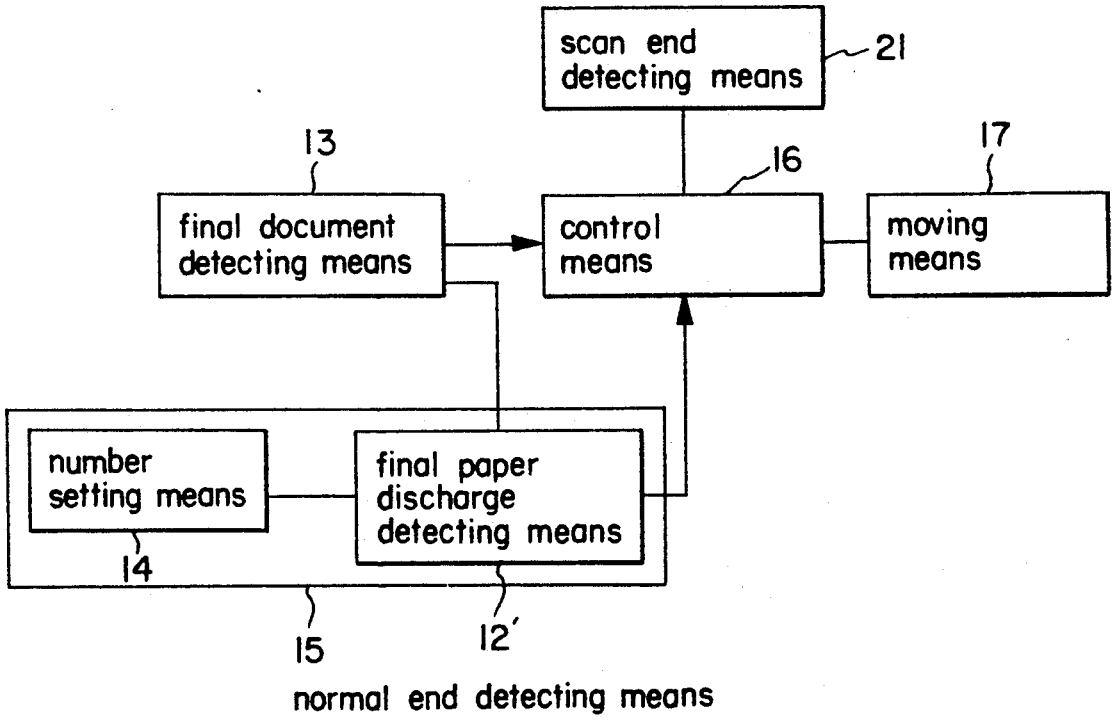
FIG. 2 is a block diagram showing the constitution of the same embodiment.

FIG. 2 is a structural diagram of the above described embodiment. In the drawing, the final paper discharge detecting means 12' receives signals from the detection switch 13 and the number setting means 14. The final paper discharge detecting means 12' judges whether the final copy paper has been discharged on the final paper of the present set of the documents. The detection switch 12 mentioned above also is used for this purpose.

The number setting means 14 and the final paper discharge detecting means 12' are combined to compose the normal end detecting means 15 which detects whether all image forming steps have been finished normally on the final document.

Moving means 17 is composed of a motor, belt, roller and other parts, and it is the means for sending the documents from above the document tray 20, onto the contact glass 19 (as an example of the document mounting means), and then for sending the documents from the contact glass 19 into the discharge tray 20.

Control means 16 receives detection signals from the detection switch 13 and from the final paper discharge detecting means 12', and then controls the moving means 17 so as to send the final document to the outside after all image forming steps have been done normally.

A detection switch 21, as an example of the scan end detecting means, is a switch for detecting whether the optical system 4 has reached the position of finishing the scanning under the contact glass 19. The signal from this detection switch 21 is fed into the control means 16.

Figure 3:
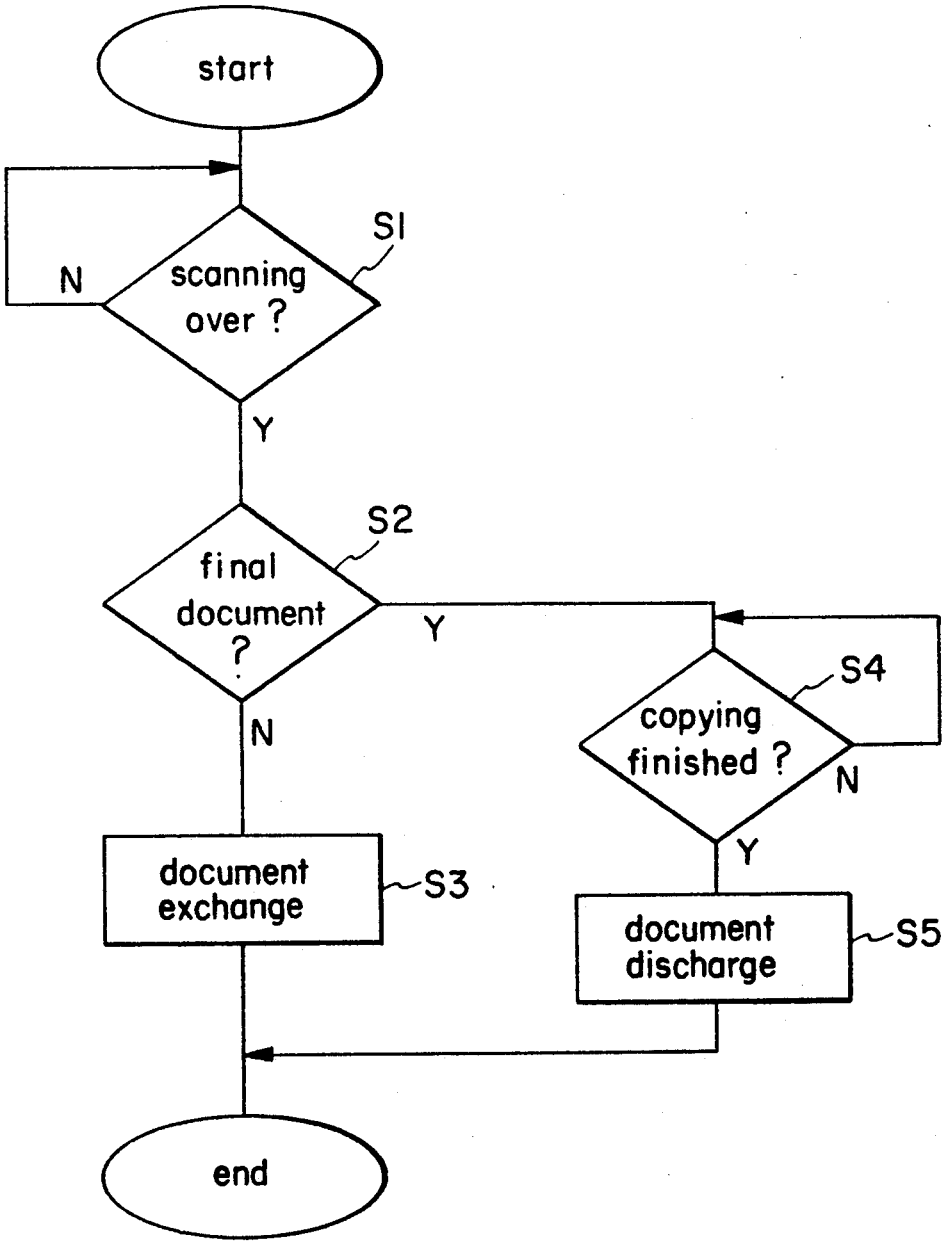
FIG. 3 is a flow chart for explaining the operation of the same embodiment.

The operation of this embodiment is described below, in conjunction with FIG. 3.

A first document is sent onto the contact glass 19 by the moving means 17. Consequently, the optical system 4 waiting at the home position moves along the contact glass 19, and when this optical system 4 is detected by the detection switch 21, the scanning is over (step S1). At this time, the image light is emitted onto the photoreceptor 5 which is exposed. The photoreceptor 5 is further developed by the developing means 6, and the image is transferred on the paper by the transfer means 7. The image is later fixed thermally to the paper by the thermal fixing device 8, and the paper is discharged onto the discharge tray 11. This discharge is detected by the detection switch 12. In this way, when the scanning by the optical system 4 is over, the optical system 4 returns to the home position in the extinguished state. The scanning operation is repeated by the number of times set by the number setting means 14. When the scanning for the final copy is over, in order to operate at high speed, the control means 16 immediately discharges the document onto the discharge tray 20 by utilizing the moving means 17 (steps S2, S3).

The next document is sent onto the contact glass 19. The document is similarly copies, and the following documents are sent in successively and sent out in the same manner (steps S1, S2, S3).

Finally, the detection switch 13 detects that the final document is sent onto the contact glass 19 (step S2). This final document is copied successively (step S4). On the final document, when the optical system 4 finishes scanning for the final copy, the document is not immediately sent out into the discharge tray 20 as in the previous procedure. That is, the final sheet discharge detection means 12' detects whether the preset number of copies have been finished normally or not by making use of the detection switch 12. When the final copy paper is detected by the detection switch 12, and the normal termination of copying is confirmed, the document is discharged into the discharge tray 20 (step S5). As a result, if there is jamming in the thermal fixing device 8 or the like, then the copying may be resumed only by clearing the jam. It is not required that the operator return the discharged final document to the inlet side of the ADF.

In this embodiment, the sorter is not used, but as indicated by the double dot chain line in FIG. 1, where the sorter 9 is used, the normal copy end may be distinguished without jamming in the sorter. Therefore, the normal end may be recognized by using, instead of depending on the detection switch 12, any other switch for detecting the normal discharge into each tray of the bin of the sorter. Alternatively, the means of detecting the normal end may be arbitrary, depending on the type of the apparatus.

Incidentally, the document setting means of the present invention is not limited to the tray alone.

Furthermore, the document mounting means of the present invention is not limited to the contact glass alone.

The final document detecting means of the present invention may be, instead of the detection switch 13 as shown in the drawing, any means for setting the number of documents by numeric key pad, detecting the variation by the switch, and detecting the final document. In short, the final document detecting means may be anything capable of detecting the final document.

The moving means of the present invention is not limited to the belt type, as shown in the drawing.

The normal end detecting means of the present invention may be realized also by means other than the combination of the number setting means and the detection switch 12, as disclosed in the embodiment.

The present invention may be applied also to a circulating type automatic document feeder. In such a case, it is advantageous because the operator is liberated from the control operation of returning the documents to the initial position, by making use of the circulating system.

The control means of the present invention may be realized either in software by using a computer, or in hardware by using a circuit for the same function.

The present invention may be applied, needless to say, not only to copiers, but also to printers and other devices.

According to the present invention, as described herein, by detecting if the document sent out from the document setting means onto the document mounting means is the final one or not by the final document detecting means, and by detecting whether all image forming steps have been normally finished (at least on the final document) by the normal end detecting means, and by controlling the apparatus to send the final document to the outside only after all image forming steps have been normally finished on the basis of the detection signals from the final document detecting means and the normal end detecting means, the present invention can offer an automatic document feeder that, if the final document is jammed, it can be cleared without again setting the document onto the document setting means. Therefore, this apparatus is capable of forming images as fast as possible.

We claim:

1. An automatic document feeder for automatically feeding a plurality of documents on original setting means onto original mounting means of a main body of an image forming apparatus and sending the documents outside, comprising:

final document detecting means for detecting whether the document sent from the original setting means onto the original mounting means is a final document or not, normal end detecting means for detecting whether all image forming steps have been completed normally or not as to the final document, moving means for moving the documents, and control means for controlling the moving means so as to send the final document outside after all image forming steps have been completed normally, and said control means controlling the moving means so as to send out documents other than the final document before all image forming step have been completed normally.

2. An automatic document feeder in accordance with claim 1, wherein said normal end detecting means further detects whether a post-processing of a sorter has been normally completed.

3. An automatic document feeder in accordance with claim 1, wherein said final document detecting means is a switch for detecting a presence of documents on the original setting means.

4. An automatic document feeder in accordance with claim 1, wherein said final document detecting means includes means for detecting a number of documents fed to the original mounting means, comparing the number with a preset number and thereby judging whether the document is the final document or not.

* * * * *